US007029041B2

(12) United States Patent
Keller

(10) Patent No.: US 7,029,041 B2
(45) Date of Patent: Apr. 18, 2006

(54) OVER CENTER DOOR CLOSING MECHANISM

(76) Inventor: Richard D. Keller, 1600 Wyndham Hill Dr., Hastings, MN (US) 55033

( * ) Notice: Subject to any disclaimer, the term of this patent is extended or adjusted under 35 U.S.C. 154(b) by 0 days.

(21) Appl. No.: 10/411,050

(22) Filed: Apr. 10, 2003

(65) Prior Publication Data

US 2003/0193200 A1 Oct. 16, 2003

Related U.S. Application Data

(63) Continuation of application No. 09/523,752, filed on Mar. 13, 2000, now Pat. No. 6,547,292.

(51) Int. Cl.
*E05C 3/14* (2006.01)

(52) U.S. Cl. ..... 292/242; 292/45; 292/48; 292/201; 292/235; 292/DIG. 36; 160/193; 160/207

(58) Field of Classification Search ..... 292/242, 292/110, 133, 225, 235, 240, DIG. 36, 45, 292/48, 201; 160/193, 206, 207, 213
See application file for complete search history.

(56) References Cited

U.S. PATENT DOCUMENTS

| | | | | | |
|---|---|---|---|---|---|
| 1,274,443 | A | | 8/1918 | Prescott | |
| 1,630,680 | A | | 5/1927 | Twedt et al. | |
| 1,724,536 | A | * | 8/1929 | Wardwell | 292/235 |
| 2,177,275 | A | * | 10/1939 | Bird | 49/203 |
| 2,548,042 | A | | 4/1951 | Mosher | |
| 2,857,192 | A | * | 10/1958 | Peterson | 292/223 |
| 3,024,838 | A | | 3/1962 | Egleston et al. | |
| 3,614,974 | A | | 10/1971 | Tajima | |
| 4,080,757 | A | * | 3/1978 | Westerman | 49/322 |
| 4,088,172 | A | | 5/1978 | Pollock | |
| 4,484,613 | A | | 11/1984 | Timoschuk | |
| 4,545,418 | A | | 10/1985 | List et al. | |
| 4,609,027 | A | | 9/1986 | Keller | |
| 5,168,914 | A | | 12/1992 | Keller | |
| 5,343,923 | A | | 9/1994 | Keller | |

(Continued)

FOREIGN PATENT DOCUMENTS

AU 245972 AU 4/1961

OTHER PUBLICATIONS

Advertisement, "Inside View of Bi-Fold Door".

(Continued)

*Primary Examiner*—Brian E. Glessner
*Assistant Examiner*—Carlos Lugo
(74) *Attorney, Agent, or Firm*—Leffert Jay & Polglaze, P.A.

(57) ABSTRACT

A door closing mechanism for pulling a door tight to a frame to which the door is mounted comprises a latch arm assembly having a latch arm pivotally secured to a panel of the door and pivotable between a first, open position and a second, latched position. An activating mechanism is operably connected to the latch arm assembly by a connecting apparatus and actuates the latch arm between its first and second positions. A latch member is secured to the jamb in which the door is mounted and is arranged and constructed so that when the latch arm is moved into its second, closed position, the latch arm engages the latch member and exerts force upon the latch member in a direction substantially normal to the plane of the door so as to cause the door to contact the door frame over substantially its entire height.

13 Claims, 7 Drawing Sheets

U.S. PATENT DOCUMENTS

| | | | | |
|---|---|---|---|---|
| 5,404,927 | A | | 4/1995 | Bailey |
| 5,560,658 | A | * | 10/1996 | Coolman et al. ..... 292/28 |
| 5,601,131 | A | | 2/1997 | Morris |
| 6,199,617 | B1 | | 3/2001 | Schweiss |

OTHER PUBLICATIONS

Wilson Industrial Doors, Inc., Instruction Manual, copyright 1993, pp. 3 and 55.

* cited by examiner

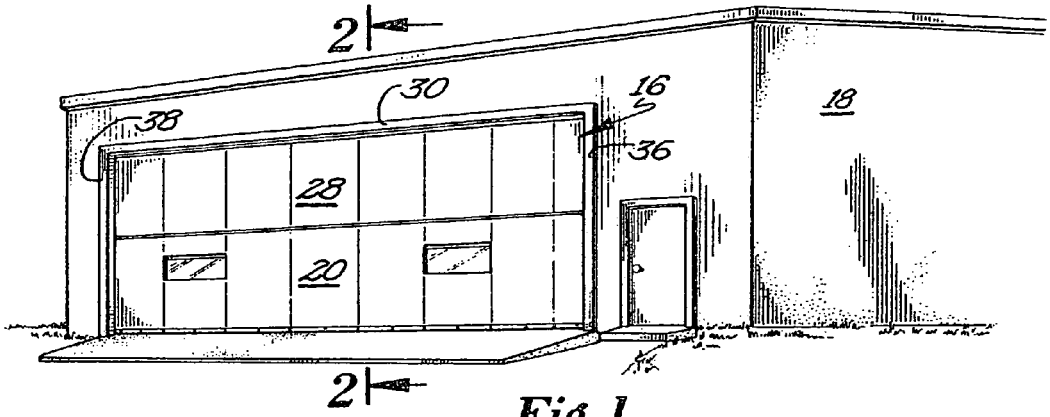
Fig 1
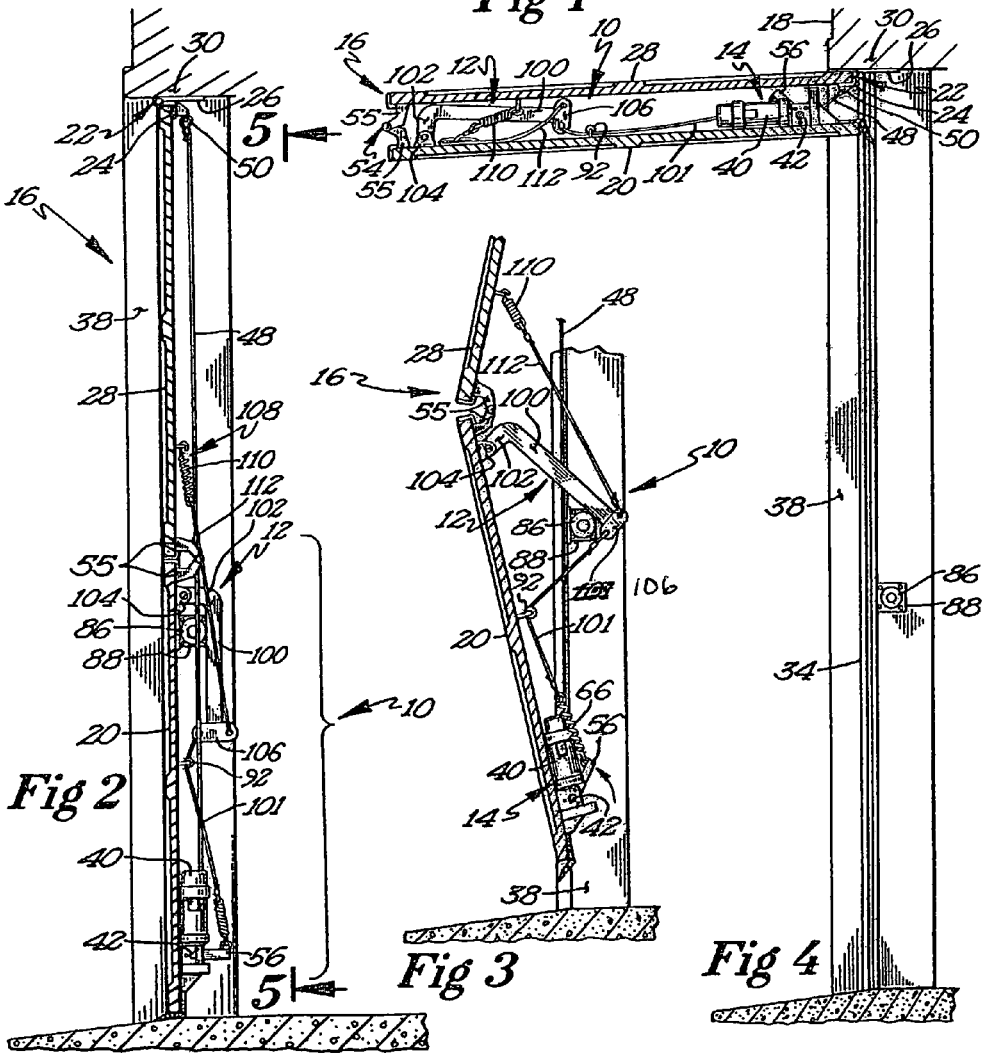

OVER CENTER DOOR CLOSING MECHANISM

This application is a continuation of 09/523,752, filed Mar. 13, 2000, now U.S. Pat. No. 6,547,292.

BACKGROUND OF THE INVENTION

1. Field of the Invention

The present invention relates to a mechanism for sealing a door tight to a door frame in which the door is mounted. More specifically, the present invention is an over-center door latching mechanism for sealing a bifold door tight to the frame in which it is mounted.

2. Description of The Related Art

A typical overhead bifold door assembly, such as that described in U.S. Pat. No. 4,609,027, issued to Keller on Sep. 2, 1986, includes an upper door panel and a lower door panel, with the upper door panel hingedly connected to the lintel or header of the door frame. When in its first, closed position, the panels of the overhead door are vertically aligned and cooperate to close the doorway, while in its second, open position the panels of the overhead door are in a folded, generally horizontal, parallel relation. Generally, a door of the size contemplated by the present invention is movable by a winch mounted to the lower door panel, with the winch having a cable extending to a fixed location above the doorway for vertically raising and lowering the bottom edge of the lower door panel and bringing the overhead door to its closed position.

Various systems have been developed to address the need for a locking mechanism that will securely lock the panels in their closed, vertically aligned position. In the above-mentioned U.S. Pat. No. 4,609,027 issued to Keller, the weight of the motor and winch mounted on the lower door panel were relied on to act as an anchor to provide dead weight to help keep the door closed. However, such an arrangement would not necessarily provide the affirmative latching action desired to maintain securely the overhead door in its closed position.

An example of a latching system is disclosed in U.S. Pat. No. 4,903,747 issued to Johnson on Feb. 27, 1990. The system disclosed in this patent, however, is directed to a device usable with a pair of relatively small, vertically disposed left and right bifold door assemblies used as closet doors, window shutters, or the like, and cooperates with the inner panels of the two bifold door assemblies. Further, the system disclosed in this patent does not operate automatically as a part of the door opening and closing operation.

Another example of a latching mechanism is disclosed in U.S. Pat. No. 4,637,446 issued to McQueen et al. on Jan. 20, 1987, which shows a spring biased latching system. The system disclosed in this patent shows a latch member that engages a catchplate mounted on the door track. Opening and closing of the door is done manually, however, with a lift cable being used to disengage the latch member from the catchplate.

U.S. Pat. No. 5,168,914, also issued to Keller, discloses a latching assembly, which includes a latch arm cooperating with a latch member affixed to an adjacent doorjamb. The latching mechanism of U.S. Pat. No. 5,168,914 includes a latch shaft that is rotatably mounted to a latch bracket which is itself attached to the door. A latch arm is affixed to one end of the latch shaft so as to be able to engage the latch member secured to the door jamb to which the door is mounted. The opposite end of the latch shaft has affixed thereto a first tensioning arm, which is arranged generally parallel to the latch arm secured to the opposite end of the latch shaft. The latch shaft is spring biased so that the latch arm is normally rotated away from the latch member secured to the doorjamb. An actuation assembly is operatively connected to the latching mechanism by a cable secured to the tensioning arm of the latching mechanism. In order to securely latch and latching mechanism, the actuation assembly applies tension to the cable secured to the tensioning arm which in turn transmits a moment to the latch arm, thereby rotating the latch arm downward and into contact with the latch member affixed to the doorjamb. The force exerted upon the latching member secured to the doorjamb by the latch arm acts to pull the door panel into contact with the door jamb thereby latching and sealing the door.

A door latching mechanism manufactured and marketed by Schweiss Distributing, Inc. of Fairfax, Minn. comprises a latch arm which is pivotally mounted to a panel of a bifold door. This latch arm contacts a latch member substantially at the distal end of the latch arm. The latch arm of the Schweiss mechanism is urged into contact with the latch member secured to the doorjamb by a cable and pulley arrangement coupled to the latch arm also substantially at the distal end thereof. Because the point of contact between the latch arm and the latch member attached to the doorjamb is at substantially the same location as the point of connection for the cable and pulley system to the latch arm, i.e. at the distal end of the latch arm, the Schweiss door latching mechanism operates by main force alone and does not realize a mechanical advantage.

Accordingly, it is an object of this invention to provide a mechanism for securely locking and sealing a door such as a bifold door to the door frame in which the door has been mounted. In addition, it is an object of this invention to provide a door sealing mechanism that may be actuated by a number of distinct actuation mechanisms. Finally, it is an object of this invention to provide a door sealing mechanism which applies a sealing force to a door which is substantially normal to the plane of the door and which utilizes the mechanical advantage of a lever to limit the magnitude of forces which must be applied to the latching mechanism by a chosen actuation mechanism.

These and other objectives and advantages of the invention will appear more fully from the following description, made in conjunction with the accompanying drawings wherein like reference characters refer to the same or similar parts throughout the several views.

SUMMARY OF THE INVENTION

The door closing mechanism of the present invention includes a latch arm assembly and an actuation mechanism or assembly. The latch arm assembly includes a latch arm that is pivotally secured to a panel of a bifold door. The latch arm is pivotable between a first, open position and a second, latched position. A latch member is secured to the jamb of the door frame to which the door frame is mounted. The latch member is mounted to the jamb adjacent to where the latch arm assembly is mounted to the door panel so that the latch arm may engage the latch member when the latch arm is in its second, latched position. A spring biasing mechanism is preferably connected between the door panel and the latch arm to bias the latch arm towards its first, open position.

A bracket having a pivot pin is used to secure the latch arm to the panel of the bifold door. In a preferred embodiment of the present invention, an offset arm or bar, rather than the latch arm itself, is rotatably mounted on the bracket pivot pin with the latch arm being secured to the distal end of the offset arm.

In order to realize the mechanical advantage present in the latch arm assembly, the latch member, which may comprise a rigid bracket or roller bearing affixed to the door jamb in which the door is mounted, is located such that the latch arm contacts the bracket along a first half of the latch arm nearest the pivot point of the latch arm. In some applications of the present invention, it may be preferred to have the latch arm contact the latch member bracket along the first third of the latch arm nearest the pivot point of the latch arm.

It is preferred to arrange and construct the latch member so that when the latch arm is moved into its second, closed position, the force exerted upon the latch member by the latch arm is substantially normal to the plane of the door so as to cause the door to contact the door frame over substantially its entire height. In addition, it is preferable that the latch arm be substantially parallel to the panel of the bifold door when in its second, latched position.

The connecting means is the operative connection between the actuation mechanism and the latch arm assembly and transmits the motive power that moves the latch arm from the actuation mechanism to the latch arm assembly. The actuation mechanism which is used to move the latch arm between its first and second positions may comprise a hand-operated winch or a lever arm that is pivotally secured to a panel of the bifold door. Another embodiment of the actuation mechanism includes a cylindrical threaded portion having a first end and a second end with the cylindrical threaded portion being co-axial with, and secured to, a power shaft mounted upon the door for raising and lowering the door. The power shaft is operatively connected to a motor for rotating the power shaft. A threaded nut travels along the cylindrical threaded portion and has a connecting arm projecting therefrom. The connecting arm is attached to the connecting means which in turn connects to the latch arm assembly. A stopping segment is located near an end of the cylindrical threaded portion for the purpose of confronting the threaded nut which travels along the cylindrical threaded portion. When the threaded nut confronts the stopping segment, the threaded nut, and hence the connecting arm, rotate with the power shaft to actuate the latch arm assembly.

DESCRIPTION OF THE DRAWINGS

FIG. 1 shows a perspective view of the outside of a typical structure having an overhead bifold door in its vertical, closed position;

FIG. 2 shows a cutaway view taken along line 2—2 of FIG. 1 showing an end view of the over-center door latching mechanism in the fully latched position;

FIG. 3 shows a view similar to that of FIG. 2 but with the door somewhat opened and the over-center door latching mechanism in the unlatched position;

FIG. 4 shows a view similar to that of FIG. 3 but with the overhead bifold door in its fully open position;

DETAILED DESCRIPTION

Figure 5:
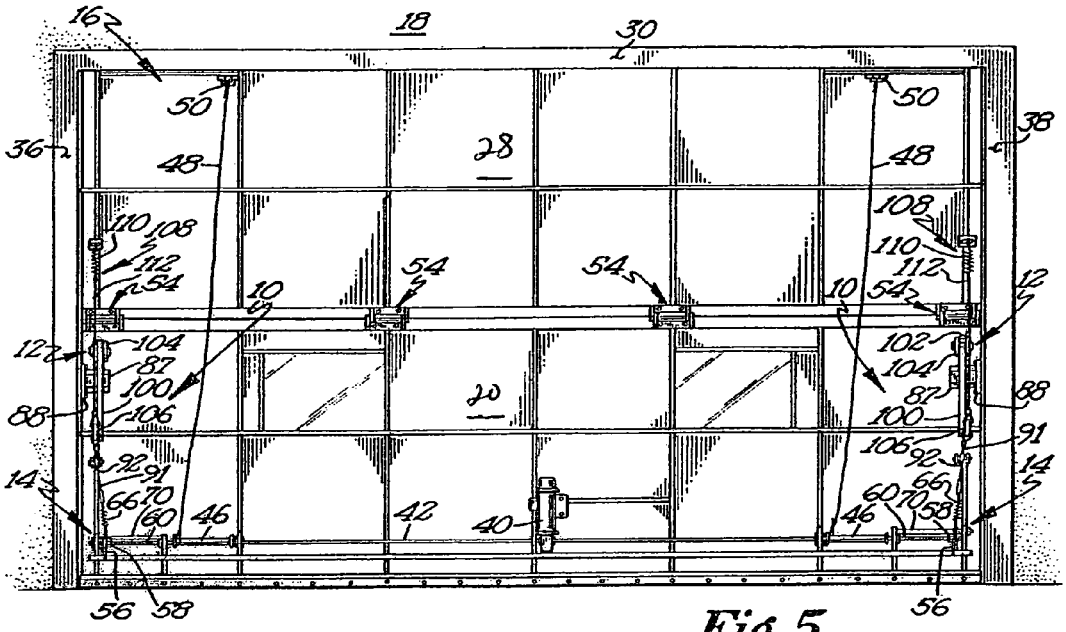
FIG. 5 shows a rear view of the overhead bifold door in its closed, vertical position, with an over-center door latching mechanism installed on both ends of the overhead bifold door.

Although this disclosure of the present invention is detailed and exact to enable those skilled in the art to practice the invention, the physical embodiments herein disclosed merely exemplify the invention, which may be embodied in other specific structure. While the preferred embodiment has been described, the details may be changed without departing from the invention, which is defined by the claims.

With reference to the drawings the over-center door latch mechanism for an overhead bifold door is generally indicated by reference numeral 10. Door latch mechanism 10 includes a latch arm assembly 12 and an actuation assembly 14. In its preferred embodiment, door latch mechanism 10 is mounted on the inside surface of an overhead bifold door 16 covering an opening to a garage or other utility building 18 (FIG. 1). Door latch mechanism 10 is preferably mounted to the first or lower panel 20 of overhead bifold door 16, although embodiments are envisioned that include a door latch mechanism 10 on both panels of overhead door 16. Further, door latch mechanism 10 may include latch arm assemblies 12 located on both ends of overhead bifold door (FIG. 5), in which case an actuation assembly 14 is required for each latch arm assembly 12. Alternatively, a single actuation assembly may be constructed and arranged to actuate each of the latch arm assemblies. (FIGS. 9, 11–12) Yet a third latch arm assembly 12 may be provided, mounted to the upper panel 28 of overhead bifold door 16. A third latch arm assembly 12 so described may be actuated by means of an actuation assembly 14 already provided for one of the first two latch arm assemblies 12.

Figure 6:
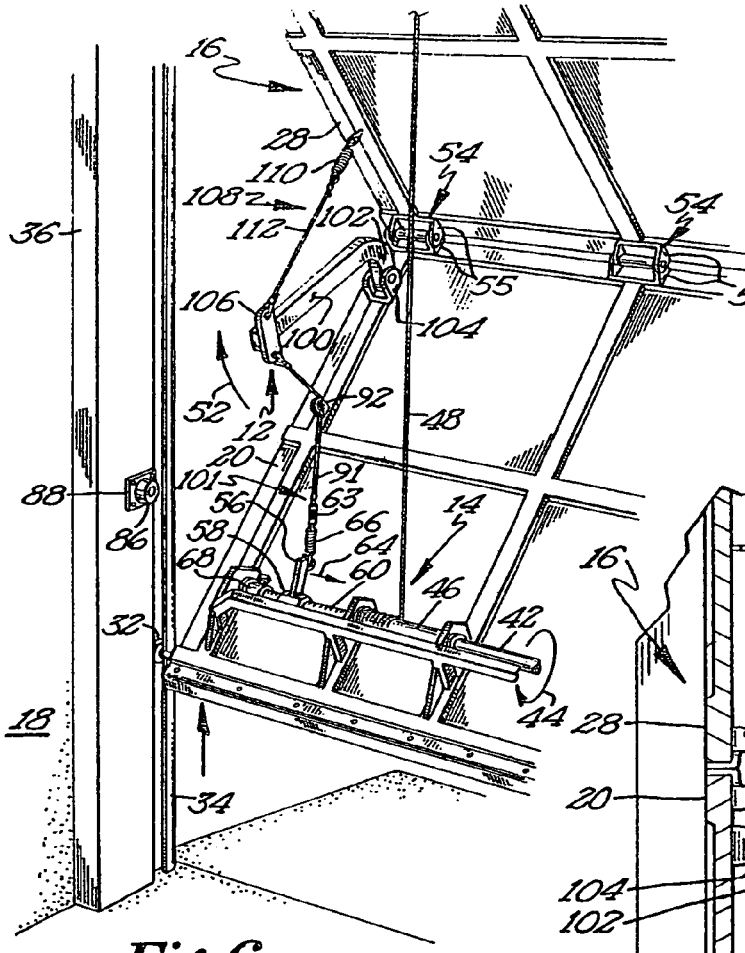
FIG. 6 shows a rear perspective view of the over-center door latching mechanism mounted on an overhead bifold door as the door is being opened.

Overhead bifold door 16 may be attached to building 18 by any number of means, including by hinge means 22 that includes first attachment plate 24 and second attachment plate 26, as shown in FIGS. 4–6. First attachment plate 24 is fixedly attached as by screws to the second or upper panel 28 of overhead bifold door 16, and second attachment plate 26 is fixedly attached as by screws to the lintel or horizontal header 30. In the embodiment shown, both lower corners of lower panel 20 include projecting therefrom rollers 32 that ride within tracks 34. One track 34 is mounted to first door jamb 36 and the other track 34 is mounted to second door jamb 38.

As shown in FIGS. 2–5 and 9–12, an electric motor 40 is mounted to lower panel 20 of overhead bifold door 16. The preferred embodiment of this device includes motor 40 to raise and lower overhead bifold door 16, although a manual winch system may be substituted for the motor. Further, motor 40 may be mounted to upper panel 28, header 30 or an interior wall portion of building 18 above or otherwise adjacent to overhead bifold door 16. Overhead bifold door 16 is raised when a switch mounted on an interior wall surface of building 18 is turned to start motor 40. Motor 40 then rotates power shaft 42 in the direction of arrow 44 (FIG. 6), which in turn rotates take-up shaft 46, which is a coaxial extension of power shaft 42. Take-up cable 48, an end of which may be fixedly attached to an upper portion of overhead bifold door 20, as at hook 50 projecting from first attachment plate 24 (FIGS. 2 and 4), is then wound around take-up shaft 46, and the lower edge of overhead bifold door 16 is raised in the direction of arrow 52 (FIG. 6), causing panels 20 and 28 to fold about hinges 54, fastened to upper panel 28 and lower panel 20. Hinge means 54 may include a pivot extending inward from the panels, mounted to hinge extension brackets 55 (FIGS. 2–4), as taught in U.S. Pat. No. 4,609,027, issued to Keller on Sep. 2, 1986. Such a modification serves to maximize the clearance between overhead bifold door 16 and the surface beneath, such as a garage floor, when overhead bifold door 16 is in its fully open position as shown in FIG. 4 by permitting lower door panel 20 and upper door panel 28 to approach a generally parallel relationship when open.

Figure 7:
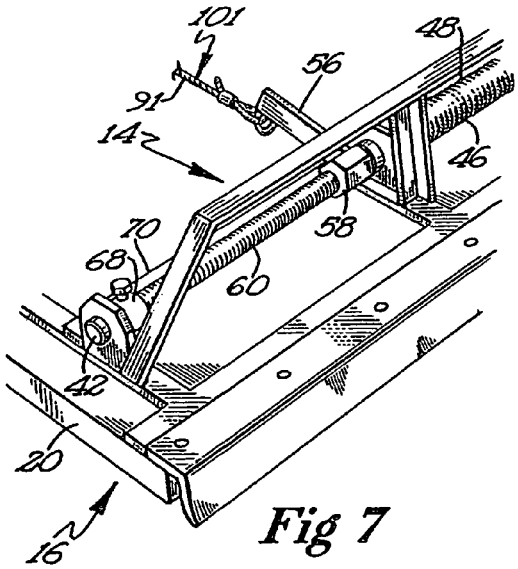
FIG. 7 shows a fragmentary, perspective view of one embodiment of the actuation assembly of the over-center door latching mechanism.
Figure 8:
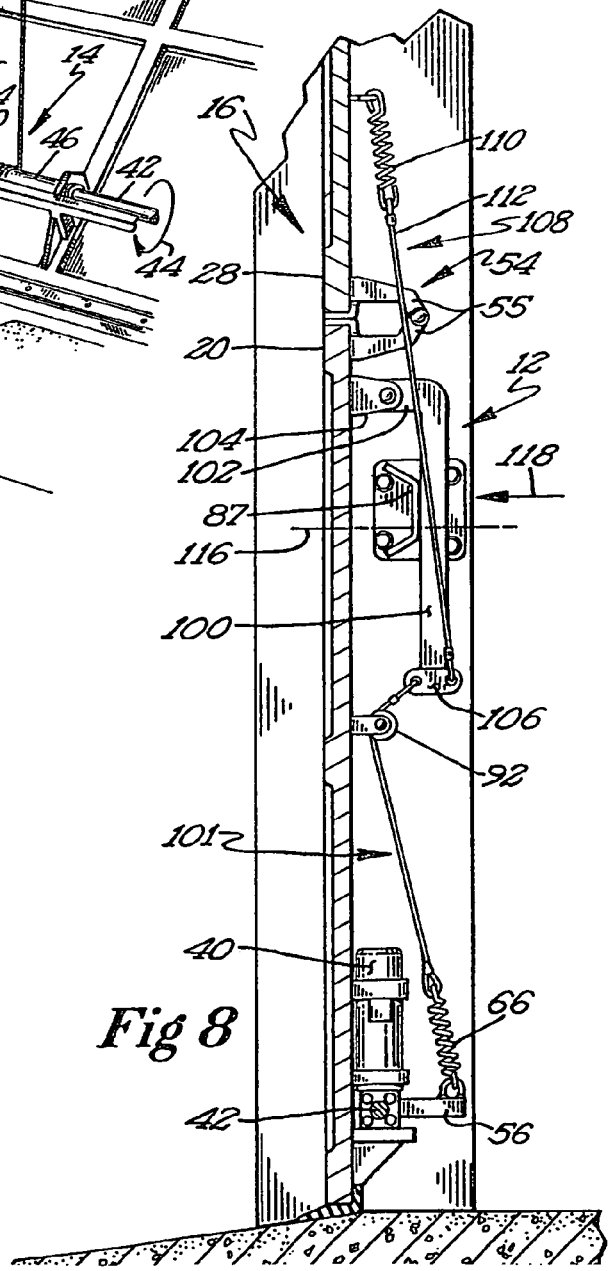
FIG. 8 shows a close up view of the latch arm assembly of the over-center door latching mechanism in its fully closed position; and, FIGS. 9–12 show perspective views of the over-center door latching mechanism mounted on an overhead bifold door with the door in its vertical, closed position and the latch arm in its latched position, each respective Figure illustrating a different embodiment of the actuation mechanism.

Referring to FIGS. 2–12 generally and specifically to FIG. 8, latch arm assembly 12 includes a latch arm 100 secured to an offset arm 102 that is rotatively mounted to the lower panel 20 of bifold door 16 by a bracket 104. In some applications of the present invention offset arm 102 may be omitted in favor of a straight or curved latch arm 100 as needed. The latch arm assembly 12 is preferably secured to the lower panel 20 of bifold door 16 near the first or second door jamb 36, 38 so that the latch arm 100 may address and engage a latch member attached to the door jamb 38 that may take the form of a rotatable metal roller 86 or a jamb bracket 87. Roller 86 is mounted to a roller shaft (not shown) projecting from a plate 88 whereas jamb bracket 87 is secured as by welding directly to plate 88. While the connection means 101 which connects the actuation assembly to the latch arm assembly 12 may be secured directly to the free end of the latch arm 100, it is preferred to secure a flange 106 to the free end of the latch arm 100 for attaching the connection means 101 to the latch arm assembly 12. Flange 106 also provides a point of attachment for a backspring assembly 108. Backspring assembly 108 comprises a spring 110 connected in line with a chain or cable 112 that is secured at is upper end to the bifold door 16 (preferably the upper panel 28 thereof, though it is envisioned that the backspring assembly 108 may also be secured to the lower panel 20 of the bifold door 16) and at its lower end to flange 106. Backspring assembly 108 acts to bias the latch arm assembly 12 into a first, open position when the bifold door 16 is open as illustrated in FIG. 4 or is being opened as in FIG. 3. The backspring assembly 108 also acts to prevent the latch arm 100 from contacting the lower panel 20 of the bifold door 16 as the door is being opened. FIGS. 3–4. The actuation assembly 14, through the connection means 101, opposes the backspring assembly 108 and acts to rotate the latch arm assembly 12 into a second, closed position in which bifold door 16 is securely latched as illustrated in FIGS. 2 and 8–12. Connection means 101 may further include a spring.

Latch arm 100 of latch arm assembly 12 has a midpoint indicated in FIG. 8 by center line 116. In order to utilize the mechanical advantage inherent in the latch arm assembly 12 of the present invention, it is important that the roller bearing 86 or bracket 87 of the latch member engage the latch arm 100 as near tot he pivot point of the latch arm 100 as possible. Preferably, the latch member will contact the latch arm 100 between the center line 116 and offset arm 102. In this manner, the forces applied to the latch arm assembly 12 by the actuation assembly 14 will be amplified by the leverage afforded by the latch arm and will achieve a satisfactory seal between the bifold door 16 and the door jambs 36, 38. Furthermore, it is important to size the offset arm 102 and locate the roller bearing 86 or bracket 87 of the latch member so that the sealing force (arrow 118 in FIG. 8) applied to the jamb bracket 87 is substantially normal to the plane created by the jambs 36, 38 and the header 30. As seen in FIG. 8, the latch arm 100 is preferably parallel to the door panel to which it is mounted when in its second, latched position. When the forces applied to the latch member are substantially normal to the plane of the door frame, the forces acting upon the door panels through the latching mechanism will also be substantially normal the plane of the door frame and will act to evenly seal the door panels 20, 28 to the door frame. Constructing and arranging the latch member and offset arm 102 as described results in a more even and complete seal between the bifold door 16 and the door jambs 36, 38.

The arrangement of the latch arm assembly 12 of the present invention is such that there exist numerous distinct actuation assemblies 14 that may be suitable for actuating the latch arm assembly 12 in securing a bifold door 16 in its closed position. A number of suitable actuation assemblies 14 are described hereinbelow.

Figure 9:
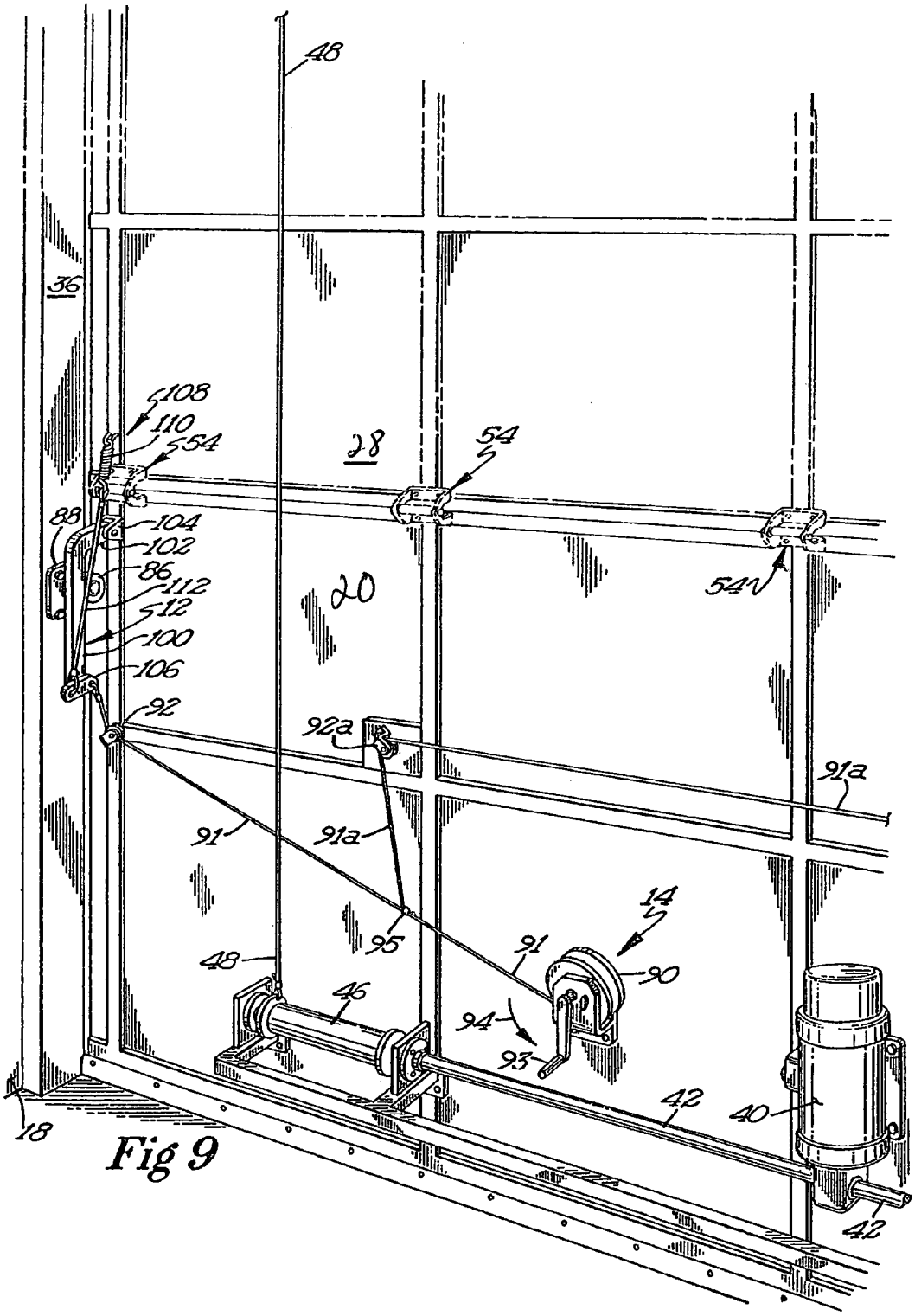

A preferred actuation assembly 14 is illustrated in FIG. 9. This actuation assembly 14 comprises a hand operated double acting winch 90 that is secured to the lower door panel 20 of the bifold door 16. A connection means 101, which is in the case of the embodiment illustrated in FIG. 9 a metal cable 91, is connected between the winch 90 and the latch arm 100 for actuation of the latch arm assembly. The cable 91 is wound about the winch 90 and passes over pulleys 92 before being secured to the latch arm assembly 12. By rotating winch handle 93 in the direction indicated by arrow 94, cable 91 is wound up on winch 90 and pulls latch arm 100 into sealing contact with roller 86 or bracket 87 of the latch member to securely lock and seal the bifold door 16 in a closed position, as shown in FIG. 9. Rotating winch handle 93 in a direction opposite of that indicated by arrow 94 will pay out cable 91, allowing back spring assembly 108 to rotate the latch arm 100 away from the latch member and thereby unlocking the latch arm assembly 14 as illustrated in FIG. 3. Where two or more latch arm assemblies 12 are in use on a bifold door 16, additional cables 91*a* may be secured to cable 91 as by splicing or by use of an appropriate fitting 95 as illustrated in FIG. 9. Pulleys 92*a* allow cable 91*a* to connect winch 90 to any additional latch arm assemblies 12.

Figure 10:
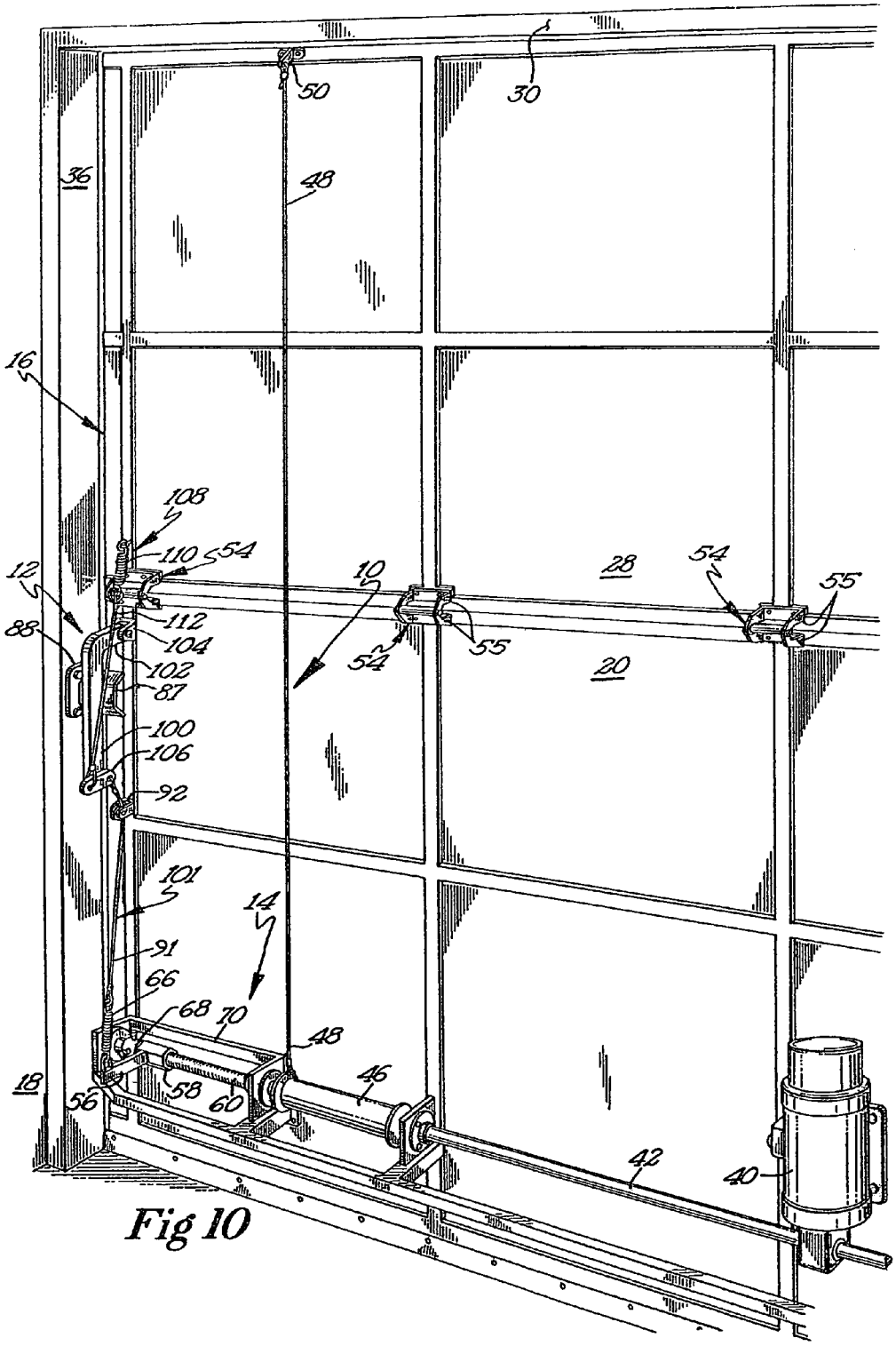

In another embodiment of the present invention, the actuation assembly 14 of door latch mechanism 10 uses motor 40 to automatically actuate latch arm assembly 12. This actuation mechanism 14 is similar to that disclosed in U.S. Pat. No. 5,168,914, issued to Keller and commonly assigned herewith. As best seen in FIGS. 6–7 and 10, the actuation assembly 14 may include an arm 56 projecting from a threaded nut 58. Threaded nut 58 is threadedly engaged with threaded rod 60, which is a coaxial extension of power shaft 42 and take-up shaft 46. Thus, as motor 40 rotates power shaft 42 and take-up shaft 46, it simultaneously rotates threaded rod 60. Each of these three rod segments—i.e., power shaft 42, take-up shaft 46 and threaded rod 60—rotates in the same direction, as, for example, indicated by direction arrow 44 (FIG. 6). To the end of arm 56 is attached connecting means 101, the other end of which is attached to latch arm assembly 12. In this embodiment, the connecting means 101 is preferably a wire cable 91 which is passed around pulleys 92 before being secured to the latch arm assembly 12. Connecting means 101 may further include an adjustment leader or turnbuckle (not shown) permitting the length of connecting means 101 to be easily lengthened or shortened. With overhead bifold door 16 in its open position (FIG. 4), motor 40 rotates power shaft 42 in the direction opposite to that indicated by direction arrow 44 (FIG. 6) to bring overhead bifold door 16 to its closed position (FIG. 2). As threaded rod 60 rotates, threaded nut 58 moves along rod 60 in a direction opposite to that indicated by direction arrow 64 (FIG. 6), moving, for example, from right to left when configured as illustrated in FIG. 6. Arm 56 is maintained in its upward extending position as it travels along threaded rod 60, as shown, for example, in FIG. 6, because of the upward tension placed on the latch arm assembly 12 by backspring assembly 108. Upon reaching the end of threaded rod 60, threaded nut 58 encounters stop 68, which is fixedly attached to and rotates with threaded rod 60. Stop 68, also coaxial with power shaft 42, now causes threaded nut 58 to rotate with threaded rod 60 approximately one quarter to one half rotation, which in turn causes arm 56 to rotate downwardly to the position shown in FIG. 10. The length of travel of threaded nut 58 along threaded rod 60 is so measured that threaded nut 58 encounters and travels with stop 68 at the very end of the closing cycle of overhead bifold door 16. The rotation of threaded nut 58 and the resulting travel of arm 56 overcomes the resistance of backspring 110 and tensions connecting means 101, thereby causing latch arm 100 to rotate from its open position as illustrated in FIGS. 3–4 to its closed position illustrated in FIGS. 2 and 10, and in doing so, securely locks the overhead bifold door 16 in its closed position.

In the embodiment illustrated in FIGS. 6–7 and 10, upon beginning the cycle that results in moving overhead bifold door 16 to the open position, motor 40 rotates power shaft 42 in the direction indicated by arrow 44, causing threaded rod 60 also to rotate in the direction indicated by arrow 44. Threaded nut 58 and arm 56 also rotate with threaded rod 60, until arm 56 contacts bumper plate 70 (FIGS. 7 and 10). Upon striking bumper plate 70, arm 56 and threaded nut 58 break contact with stop 68, and thereafter travel along threaded rod 60 in the direction indicated by arrow 64 (FIG. 6). As threaded nut 58 and arm 56 rotate with stop 68 to the position indicated in FIG. 6, latch arm assembly 12 is released, and overhead bifold door 16 is free to move to its open position. (See FIGS. 2–4.)

Figure 11:
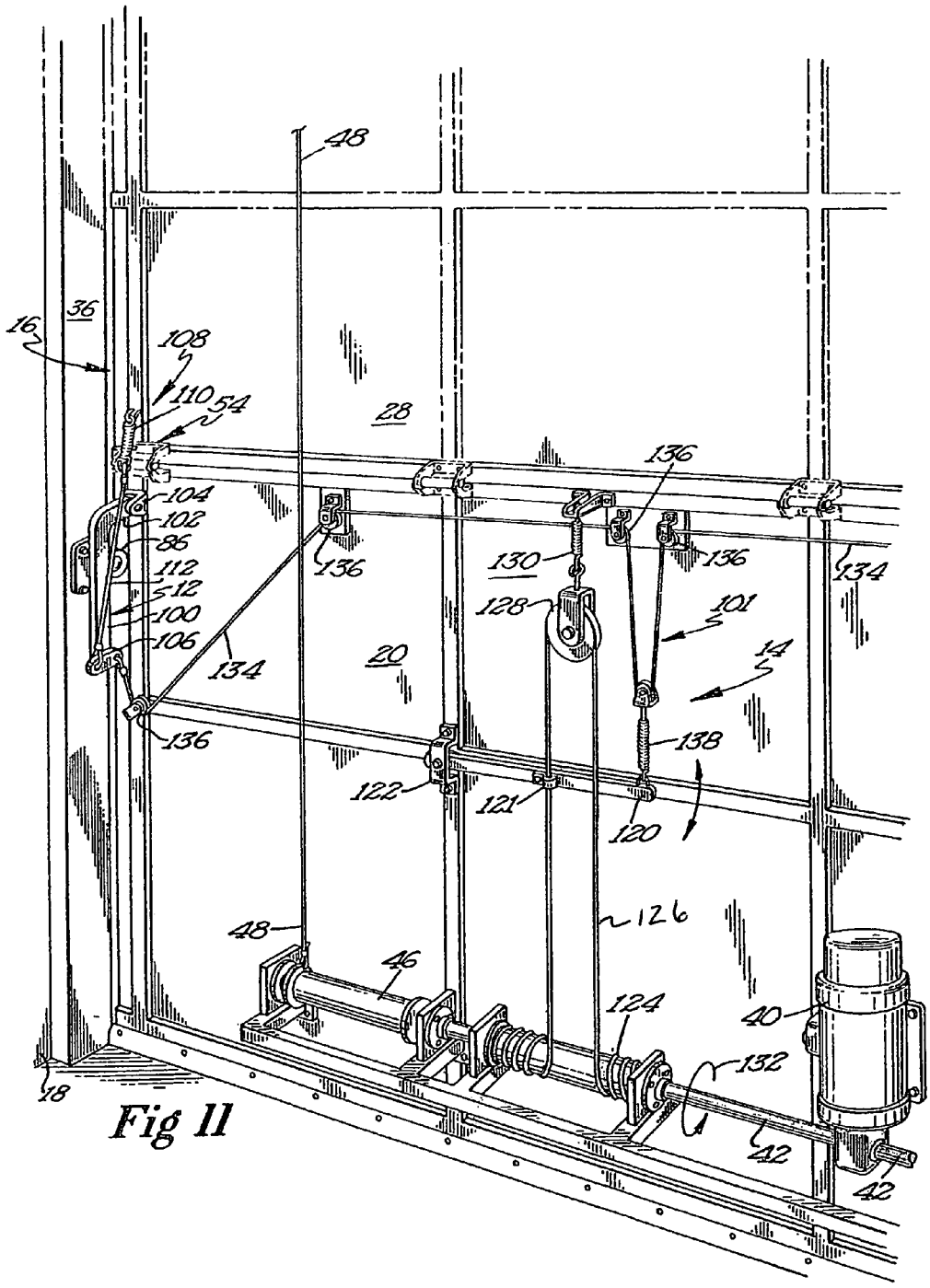

FIG. 11 illustrates another alternate embodiment of actuation mechanism 14. The embodiment of FIG. 11 includes a lever arm 120 that is rotatively secured to the lower door panel 20 of the overhead bifold door 16 by a bracket 122. A cable take up shaft 124 is connected coaxially with power shaft 42 intermediate cable take up shaft 46 and motor 40. A cable 126 is passed around a pulley 128 suspended from a spring 130 that is secured to the lower panel 20 of the overhead bifold door 16. Both ends of the cable 126 are fastened to cable take up shaft 124 so that when cable take up shaft 124 is rotated in the direction indicated by direction arrow 132, as when the bifold door 16 is being closed, cable 126 is wound up on cable take up shaft 124. As the cable 126 is wound up on cable take up shaft 124, cable 130 causes pulley spring 130 to elongate, thereby moving the pulley 128 to move to a lower position. As the cable 126 is also connected to lever arm 120 by cable fitting 121, the lever arm 120 is also rotated to a lower position as the cable 126 is wound up on cable take up shaft 124. In this lower position, the lever arm 120 places the connection means 101 under tension. In this embodiment, the connection means is a cable 134 which is passed over pulleys 136 to connect the actuation assembly 14 to the latch arm assembly 12. A spring 138 is preferably connected between the lever arm and the connection means 101 to prevent excess forces from being applied to the latch arm assembly 12. When the lever arm 120 is moved to its lower position by the action of cable take up shaft 124, the tension placed on the cable 134 overcomes the tension placed on the latch arm assembly by the backspring assembly 108 and moves the latch arm 100 to its closed position in which it bears against the latch member secured to the jamb 36. When the cable take up shaft 124 is rotated in the direction opposite that indicated by direction arrow 132, as when the door 16 is being opened, cable 126 is paid out from the cable take up shaft 124, thereby allowing pulley 128 and lever arm 120 move to their upper positions. When the lever arm 120 is rotated to its upper position, the tension placed on cable 134 is released and backspring assembly 108 biases latch arm 100 to its open position, thereby unlocking the door 16. Care must be taken to make the cable 126 the appropriate length as the cable take up shaft 124 will rotate continuously with shaft 42 as the door 16 is opened and closed. Springs 130 and 138 act to prevent the cable 128 from becoming too slack and simultaneously act to prevent the imposition of extreme forces on the connection means 101 which might damage the latching assembly 12.

Figure 12:
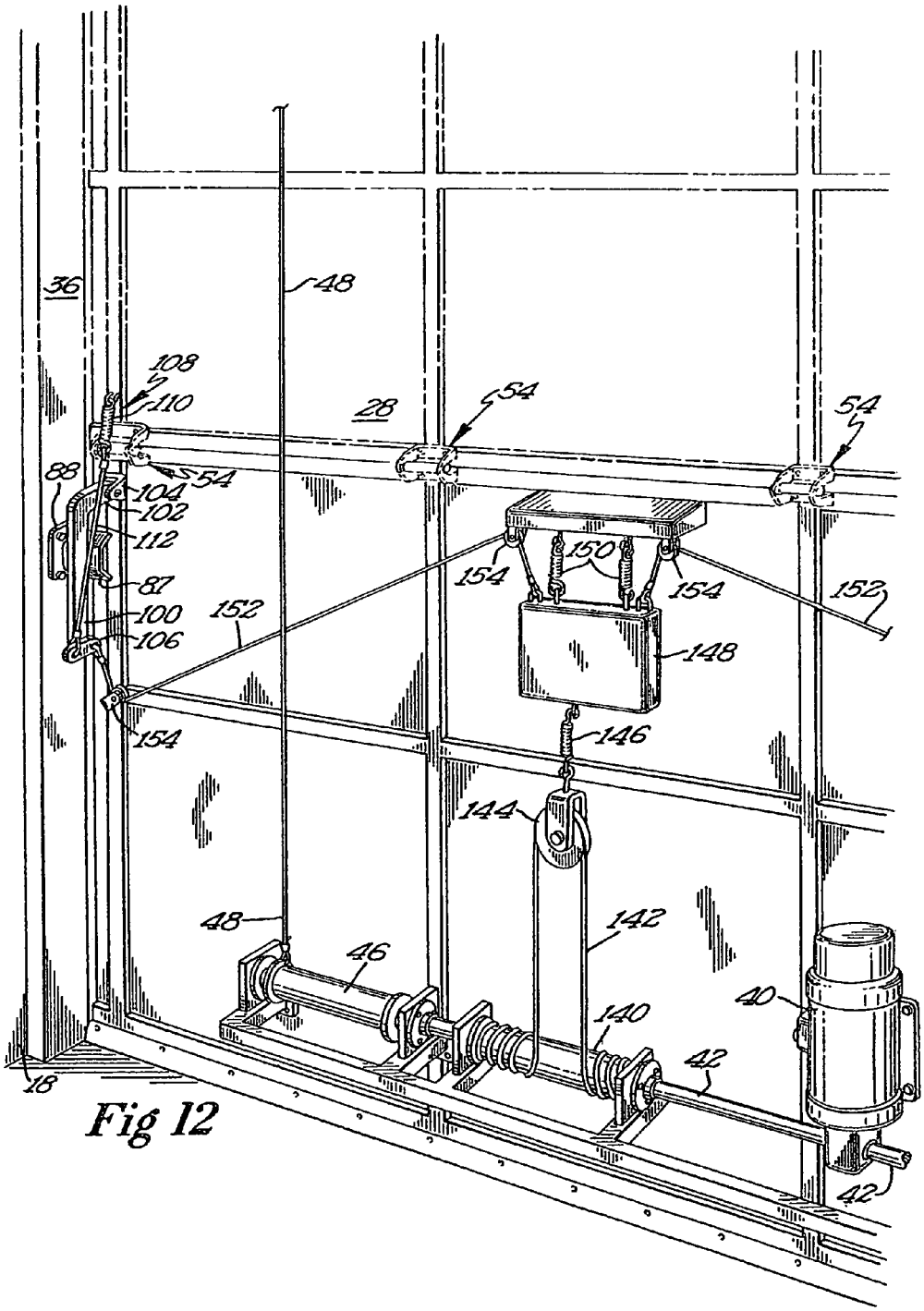

Yet another alternate embodiment of the actuation assembly 14 is illustrated in FIG. 12. Actuation assembly 14 of FIG. 12 includes a cable take up shaft 140 having both ends of cable 142 wound thereabout. The middle portion of cable 142 is passed over a pulley 144 that is suspended from block 148 by spring 146. Block 148 is in turn suspended from the lower door panel 20 of overhead bifold door 16 by springs 150. The connection means 101 of the embodiment of FIG. 12 includes cable 152 which extends from block 150, around pulleys 154, to the flange 106 of latch arm assembly 12. In closing and locking the door 16, motor 40 rotates shaft 42 in the direction indicated by direction arrow 151, thereby winding cable 142 up on cable take up shaft 142 while simultaneously paying out cable 48 from cable take up shaft 46. As cable 142 is wound up on cable take up shaft 140, pulley 144 is pulled downward. As pulley 144 moves downwards, so does block 148, and, as block 148 moves downward, tension is applied to cables 152. As the tension applied to cables 152 exceeds the biasing force placed upon the latch arm assembly 12 by the backspring assembly 108, the latch arm 100 is rotated downward into contact with the latch member. The length of cable 142 is arranged such that when the shaft 42 stops rotating, as when the door is in its fully down position, the latch arms 100 of the latch arm assembly 12 will have been rotated into their lower, closed positions so that the overhead bifold door is securely latched in its closed position as described more fully above. When the door 16 is to be opened, motor 40 rotates shaft 42 in the direction opposite that indicated by direction arrow 151. This causes cable 48 to be wound up on cable take up shaft 46 to raise the door panels 20, 28 and simultaneously pays out cable 142 from cable take up shaft 140, thereby releasing the tension on cable 152. The drop in tension in cable 152 allows the backspring assembly 108 to rotate the latch arm 100 of latch arm assembly 12 to its open position, unlocking the door and allowing the door panels 20, 28 to be folded into their open position.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A door closing mechanism for pulling a door tight to a frame to which the door is mounted comprising:

a latch arm assembly having an offset bar pivotally secured to a panel of said door and a latch arm secured to the distal end of the said offset bar, the latch arm assembly being pivotable between a first, open position and a second, latched position;

a latch member secured to a jamb in which said door is mounted adjacent to said latch arm assembly;

an activating mechanism operably connected to said latch arm assembly by a connecting means to actuate said latch arm between said first and second positions, the activating mechanism itself comprising a lever pivotally secured to said door panel and a connecting means operatively connecting said lever to a distal tip of said latch arm so that when said lever is moved from a first, open position to a second, closed position, said latch arm is rotated from its first, open position to its second, closed position.

2. The door latching mechanism of claim 1 wherein said latch arm assembly further comprises:

a bracket secured to said panel of said door, said latch arm being rotatably supported on a pivot pin affixed to said bracket.

3. The door latching mechanism of claim 1 further comprising a spring biasing mechanism connected between said door panel and said latch arm, the spring biasing mechanism biasing the latch arm towards its first, open position.

4. The door latching mechanism of claim 1 wherein said latch member comprises a roller bearing affixed to the door jamb in which said door is mounted, said roller bearing being located such that said latch arm contacts said roller bearing along a first third of the latch arm nearest the pivot point of said latch arm.

5. The door latching mechanism of claim 1 wherein said latch member comprises a roller bearing affixed to the door jamb in which said door is mounted, said roller bearing being located such that said latch arm contacts said roller bearing along a first half of the latch arm nearest the pivot point of said latch arm.

6. The door latching mechanism of claim 1 wherein the latch member is arranged and constructed so that the latch arm is substantially parallel to said door panel when the latch arm is in its second, latched position.

7. The door latching mechanism of claim 1 wherein said activating mechanism comprises a hand-operated winch.

8. The door latching mechanism of claim 1 wherein said activating mechanism comprises:

a cylindrical threaded portion having a first end and a second end, said cylindrical threaded portion being co-axial with, and secured to, a power shaft mounted upon said door for raising and lowering said door, said power shaft being operatively connected to a motor for rotating said power shaft;

a threaded nut that travels along said cylindrical threaded portion;

the lever projecting from said threaded nut; and a stopping segment near an end of said cylindrical threaded portion, whereby when said power shaft rotates, said threaded nut travels along said cylindrical portion until it confronts said stopping segment, after which said threaded nut rotates with said power shaft.

9. A door closing mechanism for pulling a door tight to a frame to which the door is mounted comprising:

a latch arm assembly having a latch arm pivotally secured to a panel of said door and pivotable between a first, open position and a second, latched position;

a latch member secured to said jamb in which said door is mounted adjacent to said latch arm assembly;

an activating mechanism operably connected to said latch arm assembly by a connecting means to actuate said latch arm between said first and second positions, the activating mechanism itself comprising a lever pivotally secured to said door panel and a connecting means operatively connecting said lever to a distal tip of said latch arm so that when said lever is moved from a first, open position to a second, closed position, said latch arm is rotated from its first, open position to its second, closed position; and, the latch arm assembly being arranged and constructed so that when the latch arm is moved into its second, closed position, the latch arm engages the latch member and exerts force upon the latch member in a direction substantially normal to the plane of the door so as to cause the door to contact the door frame over substantially its entire height.

10. A door closing mechanism for pulling a door tight to a frame to which the door is mounted comprising:

a latch arm assembly having an offset bar being pivotally mounted at one end upon a pivot pin affixed to a bracket secured to a panel of said door and one end of a latch arm being secured to the distal end of said offset bar, said latch arm pivotable between a first, open position and a second, latched position, a latch member secured to a jamb in which said door is mounted adjacent to said latch arm assembly so that the latch arm of the latch arm assembly may engage the latch member; and an actuation mechanism operably connected to said latch arm assembly by a first connecting means coupled to said latch arm of said latch arm assembly distal to a pivot pin on which said latch arm assembly pivots, said actuation mechanism being capable of moving said latch arm between said first and second positions, wherein said door is connected to said latch arm assembly by a second connecting means coupled to said latch arm of said latch arm assembly distal to said pivot pin on which said latch arm assembly pivots.

11. The door latching mechanism of claim 10 wherein the latch arm assembly is arranged and constructed so that when the latch arm is moved into its second, closed position, the force exerted upon the latch member by the latch arm is substantially normal to the plane of the door so as to cause the door to contact the door frame over substantially its entire height.

12. The door latching mechanism of claim 10 wherein the second connecting means comprises a biasing mechanism to bias the latch arm assembly toward its first, open position.

13. The door latching mechanism of claim 10 wherein another panel of said door is connected to said latch arm assembly by the second connecting means.

* * * * *